US010328452B2

(12) United States Patent
Levand et al.

(10) Patent No.: US 10,328,452 B2
(45) Date of Patent: Jun. 25, 2019

(54) DISPENSING UNIT AND METHODS FOR DISPENSING

(71) Applicant: The Sherwin-Williams Company, Cleveland, OH (US)

(72) Inventors: Victor J. Levand, Lyndhurst, OH (US); Michael O'Banion, Westminster, MD (US); Lowell D. Lueking, Lake Wylie, SC (US)

(73) Assignee: SWIMC LLC, Cleveland, OH (US)

( * ) Notice: Subject to any disclaimer, the term of this patent is extended or adjusted under 35 U.S.C. 154(b) by 0 days.

(21) Appl. No.: 15/453,416

(22) Filed: Mar. 8, 2017

(65) Prior Publication Data

US 2017/0259297 A1 Sep. 14, 2017

Related U.S. Application Data

(60) Provisional application No. 62/305,356, filed on Mar. 8, 2016.

(51) Int. Cl.
*B05C 17/005* (2006.01)
*B05C 17/01* (2006.01)

(52) U.S. Cl.
CPC .... *B05C 17/00596* (2013.01); *B05C 17/0123* (2013.01)

(58) Field of Classification Search
CPC ..... B05C 17/0123; B05C 17/00596
USPC ..... 222/81, 82, 327, 391
See application file for complete search history.

(56) References Cited

U.S. PATENT DOCUMENTS

| | | | | |
|---|---|---|---|---|
| 1,709,445 | A | 4/1929 | Tomes | |
| 2,493,891 | A | 1/1950 | McCarty | |
| 2,578,765 | A | 12/1951 | Wallace | |
| 2,788,159 | A | 4/1957 | Crewe | |
| 3,020,907 | A | 2/1962 | Lease | |
| 3,069,053 | A | 12/1962 | Nilsson | |
| 3,443,725 | A * | 5/1969 | Lawhorn | B05C 17/01 222/79 |
| 3,767,085 | A | 10/1973 | Cannon et al. | |
| 3,980,209 | A | 9/1976 | Collar | |
| 3,997,085 | A | 12/1976 | Lindquist | |
| 4,493,437 | A | 1/1985 | Breeden | |
| 4,741,462 | A | 5/1988 | Schneider, Jr. | |
| 4,974,752 | A * | 12/1990 | Sirek | B05C 17/00533 222/146.5 |
| 5,240,141 | A * | 8/1993 | Blette | B05C 17/00573 219/227 |
| 5,638,997 | A * | 6/1997 | Hawkins | A61B 17/8822 222/327 |
| 5,664,701 | A * | 9/1997 | Massena | B05C 17/00526 219/227 |

(Continued)

FOREIGN PATENT DOCUMENTS

| | | |
|---|---|---|
| WO | 1999050153 | 10/1999 |
| WO | 2005011876 | 2/2005 |

*Primary Examiner* — Vishal Pancholi
(74) *Attorney, Agent, or Firm* — Hahn Loeser & Parks LLP

(57) ABSTRACT

Embodiments of the present invention includes methods for dispensing and an apparatus for dispensing. In particular embodiments, the barrel design of an apparatus for dispensing and provided in a method for dispensing is formed to encase and/or engage a material container. By encasing and/or engaging the material container within the barrel, expansion, such as tube expansion, is reduced and/or eliminated.

15 Claims, 11 Drawing Sheets

(56) References Cited

U.S. PATENT DOCUMENTS

| | | | | |
|---|---|---|---|---|
| 5,815,925 | A | 10/1998 | Chang | |
| 5,875,928 | A * | 3/1999 | Muller | B05C 17/00553 222/137 |
| 5,887,765 | A | 3/1999 | Broesamle | |
| 6,568,832 | B1 | 5/2003 | Pillai et al. | |
| 6,716,195 | B2 * | 4/2004 | Nolan, Jr. | A61M 5/1456 604/131 |
| D511,445 | S * | 11/2005 | Childs | D8/14.1 |
| 7,073,691 | B2 | 7/2006 | Rumrill et al. | |
| 7,159,734 | B1 | 1/2007 | O'Brien | |
| 7,823,753 | B2 | 11/2010 | Kovac | |
| D640,517 | S | 6/2011 | Rumrill et al. | |
| D654,768 | S | 2/2012 | Rumrill et al. | |
| 8,544,686 | B2 * | 10/2013 | Williams | B05B 11/02 222/105 |
| D704,900 | S | 5/2014 | Childs et al. | |
| 8,857,673 | B2 * | 10/2014 | Szpak | B65D 83/0033 222/326 |
| D750,958 | S | 3/2016 | Childs et al. | |
| 2011/0049189 | A1 * | 3/2011 | Strobel-Schmidt | B05C 17/00553 222/165 |
| 2013/0025339 | A1 | 1/2013 | Costa et al. | |
| 2014/0106078 | A1 | 4/2014 | Childs | |

* cited by examiner

DISPENSING UNIT AND METHODS FOR DISPENSING

This application claims priority to, and the benefit of, U.S. Provisional Patent Application No. 62/305,356 filed on Mar. 8, 2016 with the United States Patent and Trademark Office, which is hereby incorporated by reference in its entirety.

BACKGROUND

Field

The invention described herein relates to a method for dispensing and an apparatus for dispensing.

Description of Related Art

Material dispensing units, such as caulking guns, are well known in the art. When a material container is used in combination with a dispensing unit, the structure of the material container is relied on to encapsulate, control, and maintain the movement of the contents. Material containers, however, flex under pressures exerted by dispensing units which leads to inconsistent application.

While the combination of material containers within dispensing units are known, it is desirable to improve the performance of a dispensing unit used in combination with the material containers.

SUMMARY

The dispensing unit and barrel design of the present invention provides a lightweight, durable, and efficient dispensing alternative to the caulk guns currently on the market. As used herein, the materials being used with the dispensing unit include any liquid component desired to be dispensed in a controlled manner, such as through a nozzle or the like. Examples of which include, but are not limited to, sealants, adhesives, acrylic latex products, silicone products, granular substrates, paints, coatings, waterproofing, crack sealers, liquid sealers, fireproofing, firestopping, grease, etc. Applications of these materials include, but are not limited to, interior applications, exterior applications, roof applications, joint applications, flooring applications, window applications, concrete applications, plastic applications, steel applications, building material applications, automotive applications, manufacturing applications, industrial applications, etc. For descriptive purposes, this application generally refers to sealants, however, it is understood that any of the above materials and applications are contemplated to be used with the present invention and are a part of the disclosure of the present invention.

The present invention provides for the possible adjustment between a fixed and adjustable thrust ratio and, in combination with the barrel design, provides for a more efficient dispensing of sealant material. Included in the present invention is a more efficient no-drip feature for further increased efficiency, when used independently or in combination with the barrel design of the present invention.

In the present invention, the barrel design substantially encases the material container. By encasing the material container within the barrel, expansion, such as tube expansion, is reduced or eliminated. By reducing or eliminating expansion, pushback onto the dispensing mechanism is also reduced or eliminated. Pushback reduces the effective sustained actuator strokes, thereby reducing the efficiency of the dispensing unit. Pushback occurs when the force exerted on the sealant within the material container forces the container to expand and/or bulge at its perimeter. The flexing of the container causes the plunger connected to the dispensing mechanism to be drawn back toward the dispensing mechanism, thereby interrupting or disturbing the flow of the sealant from the material container. By reducing or eliminating pushback, the efficiency of the effective sustained actuator stroke is improved. This improvement provides increased efficiency and time savings when using the dispensing unit of the present invention.

Particular embodiments of the present invention include a dispensing unit. The dispensing unit comprises a dispensing mechanism. In some embodiments, a barrel extends from the dispensing mechanism. A cavity is defined within the barrel and extends longitudinally within the barrel. The barrel includes a first barrel portion and a second barrel portion. The cavity is substantially encased between the first barrel portion and the second barrel portion when the barrel is in a closed position. The first barrel portion is attached to the dispensing mechanism and forms a seating surface for a material container. The second barrel portion is moveably attached to the first barrel portion. In various embodiments a pivot mechanism forms the point of moveable attachment. The pivot point connects the first barrel portion to the second barrel portion so they are opposite one another in an inverted relationship, when in the closed position. The second barrel portion pivots to at least one side of the first barrel point, exposing the cavity, when in an opened position. A clasp mechanism may secure the second barrel portion to the first barrel portion when in an closed position.

In other embodiments of the present invention, the barrel, as described above, may be a detachable barrel for attachment to a dispensing unit. Thereby, the barrel is claimed independent of the dispensing unit.

Additional embodiments of the present invention include methods for dispensing. Particular embodiments of a method for dispensing include inserting a material container within a barrel of a dispenser, as described above. The material container is inserted when the dispenser or barrel of the dispenser is in an opened position. The dispenser or the barrel of the dispenser is then closed into a closed position. In the closed position the material container is substantially encased within the cavity of the barrel. In the closed position the first barrel portion is secured to the second barrel portion with a clasp mechanism. To reduce expansion, the perimeter of the material container is in substantial communication with the interior surface of the barrel. The dispensing mechanism is initiated and pressure is applied to the contents of the material container from a first longitudinal end of the barrel. Sealant may be dispensed from the nozzle of the material container extending from a second longitudinal end of the barrel.

The foregoing and other objects, features and advantages of the invention will be apparent from the following more detailed descriptions of particular embodiments of the invention, as illustrated in the accompanying drawings wherein like reference numbers represent like parts of the invention.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
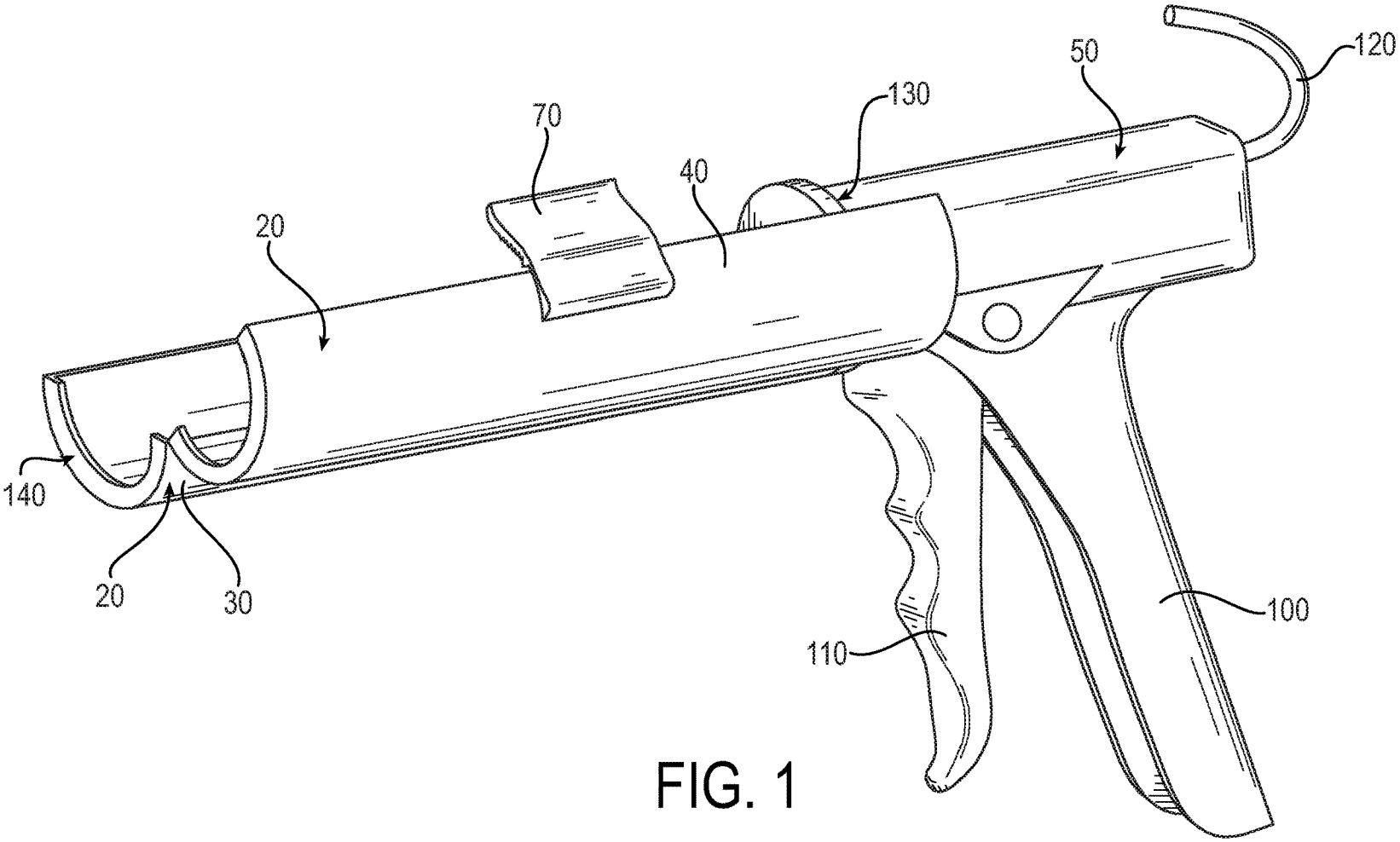
FIG. 1 is a perspective view of a dispensing unit in an open position, in accordance with an embodiment of the invention.

The present invention includes apparatus and methods for dispensing sealants. Specifically, the present invention includes apparatus and methods for dispensing sealants from pre-packaged material containers, such as sealant tubes. In embodiments of the present invention, pre-packaged material container(s) of sealants are inserted into a cavity of a barrel wherein the pre-packaged material container(s) are secured. The barrel is either an integral component of a dispensing unit or attached to a dispensing unit. In various embodiments, the inside surface of the barrel hugs or engages a significant portion of the perimeter of the pre-packaged material container(s). By engaging the perimeter of the pre-packaged material container(s), the barrel reduces and/or eliminates expansion and provides for a more consistent and efficient dispersion of the sealant from the pre-packaged material container(s). In the descriptions of the various embodiments, the pre-packaged material container(s) are referred to as the material container, below.

Embodiments of the methods for dispensing sealants include inserting a material container within a barrel of a dispensing unit. The barrel of the dispensing unit may be an integrally formed component of the dispensing unit, a removably attached component of the dispensing unit, and/or a retrofitted barrel for attachment to another dispensing unit already comprising, at least, a partial barrel or attachment means for a barrel. A cavity is formed within the barrel. In embodiments of the present invention, the material container is positioned within the cavity of the barrel such that the barrel substantially surrounds the material container. One example of a material container includes a caulk tube in a cylindrical shape. In this example, the cylindrical caulk tube is placed into the cavity of the barrel, which is additionally cylindrical, such that the curvilinear surface of the caulk tube is in substantial communication with an inside surface of the barrel. It, however, is understood that various shapes of greater or lesser complexity, and shapes having planar portions, chamfered portions, stepped portions, etc., can be substituted or added in a complimentary fashion without departing from the scope or spirit of the invention. In these variations, the perimeter of the material container extending a longitudinal direction is in substantial communication with the inside surface of the barrel. The perimeter being the outer most boundary defining the material container In embodiments of the present invention, a dispensing unit includes a dispensing mechanism and the barrel. Extending from a first longitudinal end of the barrel, and thereby a first longitudinal end of the material container positioned within the barrel, is the dispensing mechanism. The dispensing mechanism may be manually operated mechanism or a powered mechanism. By example a powered mechanism includes pneumatic devices, electrical devices, hydraulic devices, or the like. For the sake of this discussion, a manually operated mechanism is illustrated in the figures. In particular, the manually operated mechanism is an advancing mechanism with a handle and moveable trigger, moveable in relation to the handle. A user grasps both the handle and the moveable trigger with one hand moving the trigger back and forth from the handle. This movement advances or indexes a plunger, attached to the end of a drive rod extending from the dispensing mechanism, into the first longitudinal end of the material container. Examples of an advancing mechanism include a ratcheting mechanism having a sawtooth rod, a shimmying mechanism having a smooth rod, a combination thereof, or the like. The advanced plunger forces the sealant from the first longitudinal end of the material container, proximal the first longitudinal end of the barrel, to a nozzle on the material container at an opposite second longitudinal end of the material container, proximal the second longitudinal end of the barrel. The sealant is forced from the material container and dispensed through the nozzle of the material container onto a work surface. As mentioned above, a dispensing mechanism is not limited to an advancing mechanism and may include any manual or powered driven mechanism, examples of which may also include conveyor systems, pulley systems, pump systems, or the like.

In some embodiments, a release tab is provided at the dispensing mechanism for releasing the force exerted by the plunger into the first longitudinal end of the material container. Simply, the release tab disengages the dispensing mechanism from the drive rod. The release tab may also include a no-drip mechanism or be used in combination with a no-drip mechanism. The release tab of the no-drip mechanism may be designed to not fully disengage the dispensing mechanism from the drive rod but, instead, may slightly retract the drive rod, back toward the dispensing mechanism, after driving the drive rod forward. In other words and by example, the dispensing mechanism may drive the drive rod forward, but, between each advancing movement the drive rod retracts a fraction of the distance it previously advanced. This may be accomplished by providing some slack in the advancing mechanism, providing a compressible medium at the plunger, or the like. Such a retracting movement is not limited to a dispensing mechanism of the advancing type but may be incorporated with any of the dispensing mechanisms contemplated in combination with the present invention. Simply stated, for every forward movement of the plunger, a return movement of lesser quantity may be provided. The dispensing mechanism may incorporate a release tab separate from a no-drip mechanism, in combination with a no-drip mechanism, or may allow a user to choose between the release tab and the no-drip mechanism.

Another example of a no-drip mechanism includes a pliable (i.e. rubber) gasket, referred to herein as the donut, attached to the perimeter of the plunger rod. The donut is positioned between the plunger and an inside surface of the material container. In this embodiment, the donut is moveably engaged with the inside surface of the material container and has an outside diameter greater than the inside diameter of the material container (in this particular example, the material container referred to here is a cylindrical tube). The friction between the donut and the material container maintains the position of the plunger within the material container. However, since the donut has an outside diameter greater than the inside diameter of the material container, the donut provides for retraction of the plunger from within the material container in a similar manner the drive shaft is retracted, above. The donut may be used in combination with or independent of other no-drip mechanisms. When used in combination with other no-drip mechanisms, the life of the donut may be increased.

Other examples of a no-drip mechanism are found in issued U.S. Pat. No. 8,857,673 B3, entitled CAULKING GUN WITH DRIP FREE MECHANISM, and issued U.S. Pat. No. 8,904,91 B2, entitled CAULKING GUN WITH TIP CUTTER MECHANISM. Reference is made to both of these patents for general discussion of a no-drip mechanism and these references are incorporated by reference in their entirety.

In various embodiments, the dispensing mechanism may include an adjustable thrust unit for adjusting the adjustable thrust ratio (ATR). Using the advancing system as an example, the adjustable thrust unit adjusts the amount of travel effected on the drive rod in relation to the movement between the handle and the moveable trigger. In other words, the degree of travel of the plunger through the material container is adjustable as an adjustment in the ratio of the energy exerted at the handle and moveable trigger. By example, the adjustable thrust unit of the present invention would provide a reduction in the amount of travel of the push rod with each respective movement of the moveable trigger at the handle, when used with sealants of higher viscosity. In other words, the amount of energy required to move sealants of high viscosity is reduced at the moveable trigger at the handle. In contrast, when using the dispensing unit with a sealant of low viscosity, the adjustable thrust unit may be adjusted to provide an increased amount of travel at the push rod with each respective movement of the moveable trigger. The adjustable thrust unit of the present invention is contemplated to adjust the adjustable thrust ratio regardless of the type of dispensing mechanism and is thereby not limited to an advancing mechanism.

In some embodiments, the barrel may comprise a first barrel portion and a second barrel portion. In one embodiment, the first barrel portion is attached to the dispensing mechanism. The first barrel portion forms a seating surface for the material container. The second barrel portion may be moveably attached to the first barrel portion by a pivot mechanism. In the present invention, the pivot mechanism may include removable attachment, pivotal attachment, rotatable attachment, slidable attachment, and/or the like. In one embodiment, the pivot mechanism is a hinge connecting the first barrel portion to the second barrel portion. The pivot mechanism may be at the first longitudinal end, the second longitudinal end, and/or positioned along a longitudinal length of the barrel. In some embodiments, the first and second barrel portions may be entirely disengaged from one another. The barrel may further include a lip extending into the cavity at a second longitudinal end. The lip may be formed on the first barrel portion and/or the second barrel portion. This lip provides an edge for the material container to abut, thereby, maintaining the material container within the cavity.

In various embodiments, the pivot mechanism transitions the barrel between a closed position and an open position. When in the closed position, the second barrel portion faces the first barrel portion in an opposite facing direction such that the first barrel portion and the second barrel portion are in an inverted relationship. Between the first barrel portion and the second barrel portion, a cavity is formed and is substantially enclosed within the barrel. Within this cavity is where the material container is placed.

In embodiments of the method for dispensing sealant, upon inserting the material container within the barrel of the dispensing unit, the barrel is moved into the closed position. In the closed position the material container is substantially encased within the cavity of the barrel. The perimeter of the material container is in substantial communication with the inside surface of the barrel. When in the open position the second barrel portion may pivot to at least one side of the first barrel portion, thereby providing access into the cavity. As mentioned above, access may be provided into the cavity by pivoting the second barrel portion at the first longitudinal end, the second longitudinal end, and/or removing the second barrel portion from the first barrel portion, entirely. In yet other embodiments, the second barrel portion may be pivotally, rotatably, slideably and/or removably attached to the dispensing mechanism.

In combination with the pivot mechanism, a clasp mechanism may be used to secure the first barrel portion to the second barrel portion in the closed position. The clasp mechanism is affixed to the second barrel portion and removably fastened to the first barrel portion, or vice versa. The removably fastened end of the clasp mechanism may include one or more sawtooth(s) which removably engage the first barrel portion. The first barrel portion may additionally include raised edges, or oppositely facing sawtooth(s), which the one or more sawtooth(s) of the clasp mechanism engage and/or clasp onto. The clasp mechanism may be constructed of a pliable material so it is easily engaged and disengaged at the first barrel portion. In some embodiments, multiple clasp mechanisms may be used. In yet other embodiments, a clasp mechanism may be used in place of the pivot mechanism. Other clasp mechanisms are additionally contemplated and include locks, latches, hooks, bolts, screws, VELCRO® closures, or the like.

Figure 12:
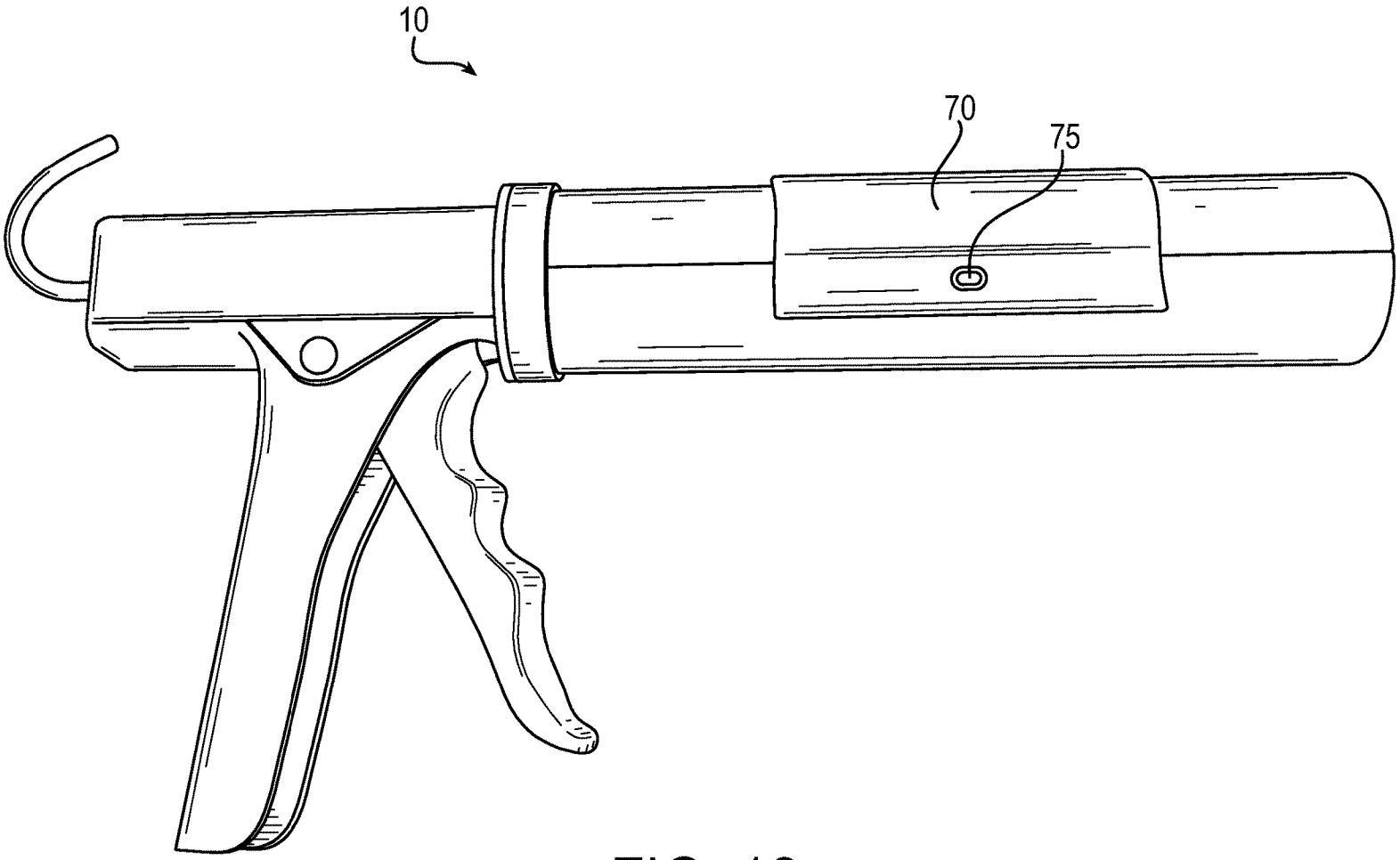
FIG. 12 is a side view of a dispensing unit in a closed position, in accordance with an embodiment of the invention.

A rapid open and/or close mechanism may also be provided. The rapid open and/or close mechanism may be separate from or in combination with the clasp mechanism. A rapid open and/or close mechanism (referred to herein as the rapid mechanism) provides for quick engagement and/or disengagement at the clasp mechanism. As illustrated by FIG. 12 such a mechanism may comprise a button 75 and/or pressure point for disengaging the clasp mechanism from the barrel. The rapid mechanism may be provided at the clasp mechanism, at the barrel, at the pivot mechanism, at the release tab, and/or at the dispensing mechanism (i.e. the handle, the moveable trigger, or the like). The position of the rapid mechanism may further increase the efficiency of use of the dispensing unit by placing it in proximity to the user's hand.

Although the description and figures illustrate and describe the components of the dispensing unit in one particular configuration, the components of the dispensing unit may be provided in an orientation of a respective handedness. Handedness includes preferences reflective of left-handedness, right-handedness, mixed-handedness, ambidexterity, or the like. By example, the current figures represent an right-handedness orientation such that when a user engages the handle with their right hand the clasp mechanism may be positioned to the left side of the barrel when facing the dispensing end of the barrel. Likewise, the clasp mechanism may be positioned to the top, bottom, or at any other position on the barrel based upon user preference, including handedness. Likewise, the pivot mechanism may additionally be positioned relative the clasp mechanism based upon the above selected preferences, including handedness. The features of the handle may also be orientated relative to handedness. By example, the release tab and/or drive rod may be oriented to one side or another of the handle, respective of handedness. Moreover, in an embodiment where the barrel is a removeably attached component of the dispensing unit, the barrel may be configured to be attached to the handle from either end. Thereby, the barrel may be flipped with respect to the handle and allow the handedness to be changed.

Embodiments of the present invention include use with material containers of a variety of sizes. In some embodiments, the dispensing unit, including the barrel, are formed to receive material containers of a respective size, including 10 ounce containers, 20 ounce containers, or the like. Regardless of the respective size of the material container, the barrel is formed to be in substantial communication with or to engage the entire perimeter of the material container. As used herein, a substantial communication with includes engagement with 80% or more of the perimeter of the material container. When the material container is in a cylindrical shape, the barrel is formed to be in substantial communication with, 80% or more, of the curved perimeter, not including the ends. Another embodiment may include a barrel which engages the entire curved perimeter, not including the ends, of a material container in a cylindrical shape.

Figure 14:
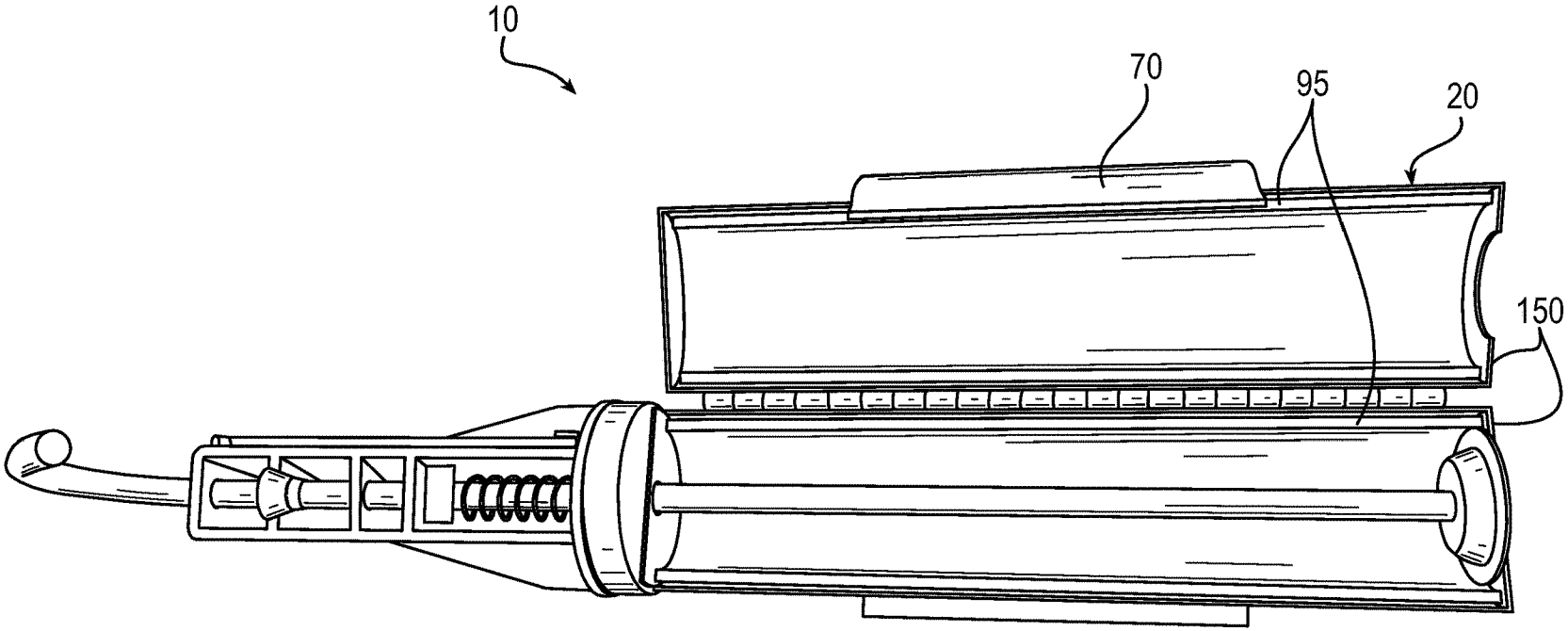
FIG. 14 is a top view of a dispensing unit in an opened position, in accordance with an embodiment of the invention.

In other embodiments, the barrel of the dispensing unit may be adjusted to accommodate material containers of different sizes. By example and as illustrated by FIG. 14, an adjustment mechanism 95 may be provided at the barrel in order to maintain the barrel in communication with the material container. The adjustment mechanism 95 may include spacers or extensions provided at the barrel or added to the barrel and, therefore, becoming a part of the barrel with respect to the amount of engagement with the material container. The adjustment mechanism 95 may compensate for material containers of various sizes or shapes, and in particular, for sizes or shapes different than the shape of the cavity formed within the barrel. By using the adjustment mechanism 95, the size of the cavity is adjusted so that the material container, upon being placed within the cavity, is in substantial communication with the inside surface of the barrel, and/or in substantial communication with the adjustment mechanism used in combination with the barrel. In some embodiments, the inside surface of the barrel may be adjustable. By example, a bladder may be used to expand and/or contract the inside surface of the barrel. Mechanical structures may, additionally or alternatively, be used to adjust the position or the size of the inside surface of the barrel. In some embodiments, the adjustment mechanism may be at the clasp mechanism and/or the pivot mechanism. By example, the barrel may expand, translate, fold, or contact at the clasp mechanism and/or the pivot mechanism. In another example, the first barrel portion may overlap the second barrel portion until the desired cavity dimensions are achieved, or vice versa.

By engaging the perimeter of the material container with the interior surface of the barrel, expansion is reduced or eliminated. Expansion occurs when the plunger, which is used to force sealant material through the material container by the dispensing mechanism, drives the sealant from the first longitudinal end of the material container to the second longitudinal end of the material container. The force exerted on the sealant within the material container forces the container to expand and/or bulge at its perimeter. Between each pump of the dispensing mechanism, the material container flexes and, in response, draws the plunger back towards the dispensing mechanism. This is referred to as plunger pushback. Plunger pushback reduces the effective sustained actuator stroke of the dispensing mechanism, thereby compromising the efficiency of the dispensing unit. By engaging the interior surface of the barrel against the perimeter of the material container, the expansion and/or bulging is reduced or eliminated. As a result, plunger pushback is reduced or eliminated. Thereby, the efficiency of the effective sustained actuator stroke is improved.

Test results performed on a prototype of the present invention, wherein the perimeter of the material container is in substantial communication with the inside surface of the barrel, illustrate the increased efficiency of the present invention. By example, in comparison to a caulk gun currently found on the market, wherein the material container is not encased in the cavity of a barrel, a 45% increase in efficiency was achieved by the present invention. In this particular test, 5.5 ounces of Loxon Polyurethane was delivered with 20 actuations of the trigger of a caulk gun, currently found on the market. In contrast, using an identical dispensing mechanism, but having the perimeter of the material container in substantial communication with the barrel, 8 ounces of Loxon Polyurethane was delivered with 20 actuations of the trigger, using an embodiment of the present invention.

Further increasing the efficiency of the dispensing unit of the present invention, a material container tip cut-off knife may be incorporated. The tip cut-off knife may be attached to the dispensing unit or may be detachable and re-attachable to the dispensing unit. Also attached to the dispensing unit, separate from or in combination with the tip cut-off knife, may be a puncture mechanism for extending through and puncturing the material container before use. The puncture mechanism may be removably, rotatably, pivotally, rigidly, slidably, etc. attached to the dispensing unit.

Referring now to the drawings wherein the figures are for the purpose of illustrating the preferred embodiments of the invention and not for purposes of limiting the same, the Figures show a dispensing unit.

Figure 2:
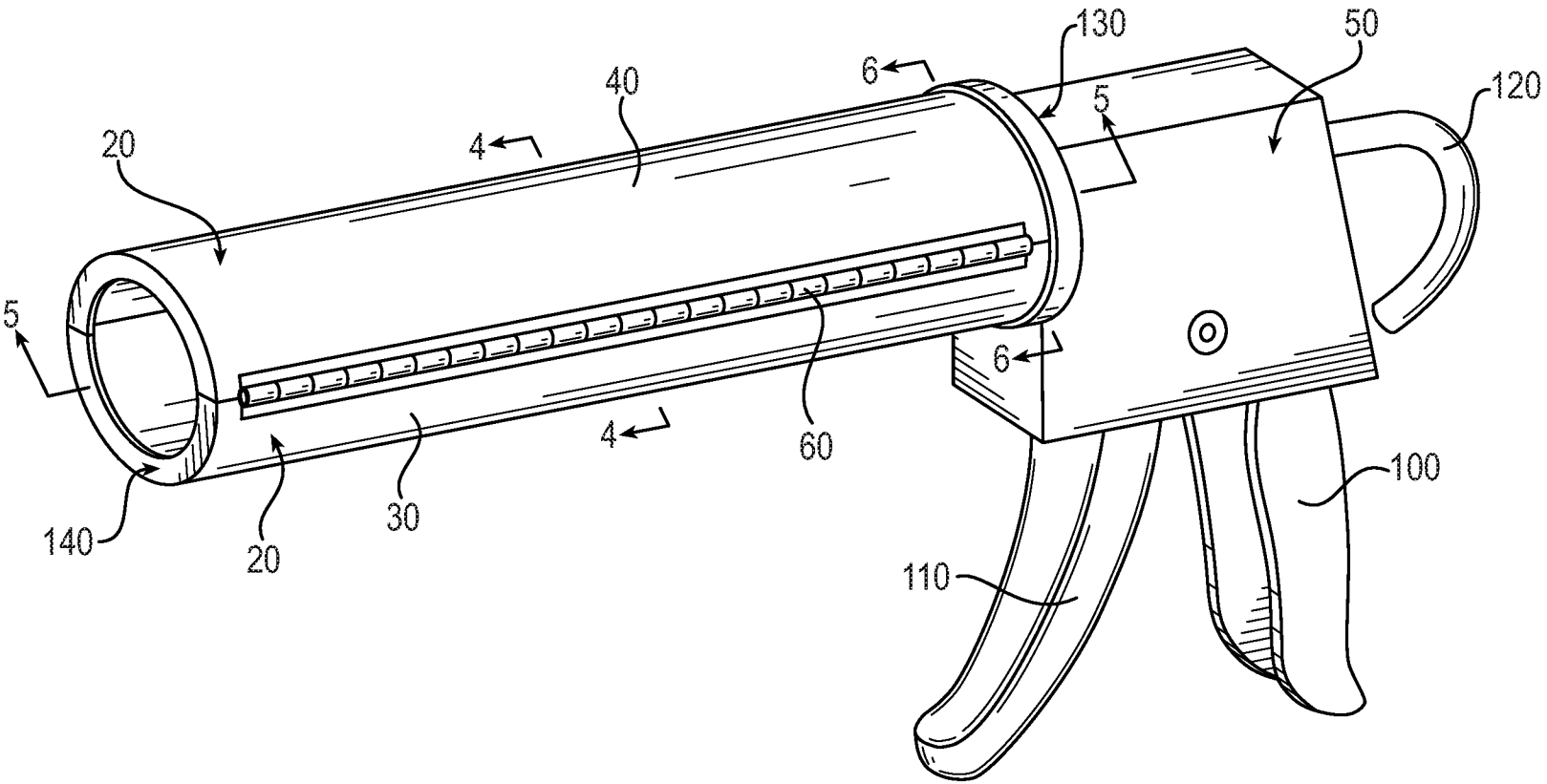
FIG. 2 is a perspective view of a dispensing unit in a closed position, in accordance with an embodiment of the invention.

FIG. 1 is a perspective view of a dispensing unit 10 in an open position. FIG. 2 is a perspective view of a dispensing unit 10 in a closed position. As shown in FIGS. 1-2, a dispensing unit 10 comprises a barrel 20. The barrel 20 includes a first barrel portion 30 and a second barrel portion 40 with an inside surface 90. A dispensing mechanism 50 is located at the first longitudinal end 130 of the barrel 20. Opposite the first longitudinal end 130 is the second longitudinal end 140. The dispensing mechanism 50 includes a handle 100 and a moveable trigger 110. Extending through the dispensing mechanism 50 and into the barrel is a push rod 120 with a plunger attached thereto within the barrel. A pivot mechanism 60 moveable connects the first barrel portion 30 and the second barrel portion 40. With particular reference to FIG. 1, attached to the second barrel portion 40 is a clasp mechanism 70.

Figure 3:
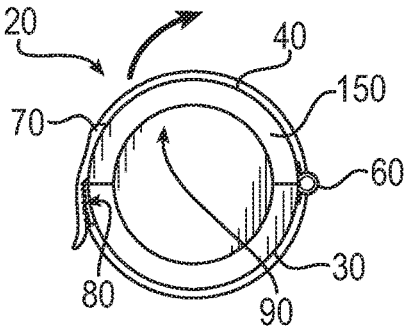
FIG. 3 is an end view, from a second longitudinal end, of a barrel of a dispensing unit in a closed position, in accordance with an embodiment of the invention.
Figure 4:
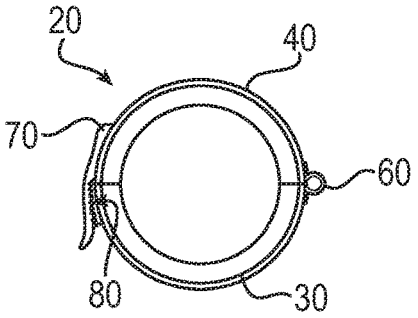
FIG. 4 is a lateral cross-sectional view of a barrel of a dispensing unit in a closed position at 4-4 of FIG. 2, in accordance with an embodiment of the invention.
Figure 9:
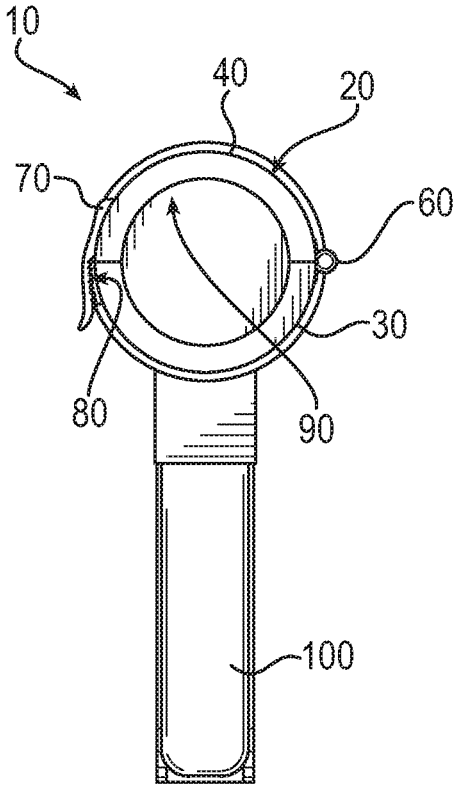
FIG. 9 is an end view, from a second longitudinal end, of a dispensing unit in a closed position, in accordance with an embodiment of the invention.

FIG. 3 is an end view of a barrel 20 from the second longitudinal end of the barrel 20 in a closed position. FIG. 9 is an end view of a dispensing unit 10 having a barrel 20 taken from the first longitudinal end of the barrel 20 in the closed position. In FIGS. 3 and 9, a lip 150 is located at the second longitudinal end, providing an edge for the material container to abut within a cavity formed by the insider surface 90 of the barrel. The barrel 20 includes a first barrel portion 30 and a second barrel portion 40 with an inside surface 90. The clamp mechanism 70 comprises sawtooth(s) 80 for engaging and securing the second barrel portion 40 to the first barrel portion 30 at the clamp mechanism 70. Laterally opposite the clamp mechanism 70 is a pivot mechanism 60 which moveably connects the first barrel portion 30 to the second barrel portion 40. The same features, aside from the lip, are illustrated in a lateral cross-sectional view of a barrel of FIG. 4. With particular reference to FIG. 9, a handle 100 is further illustrated.

Figure 5:
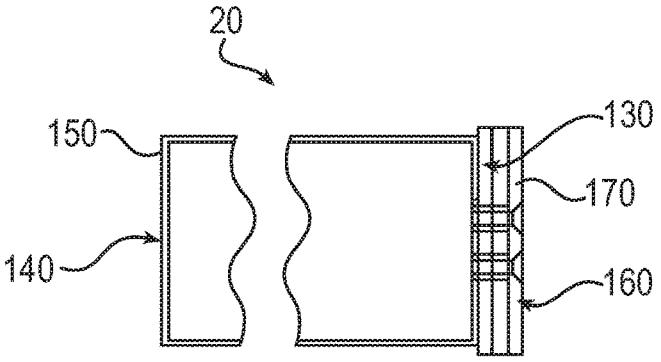
FIG. 5 is a longitudinal cross-sectional view of a barrel, including a barrel attachment mechanism, at 5-5 of FIG. 2, in accordance with an embodiment of the invention.
Figure 6:
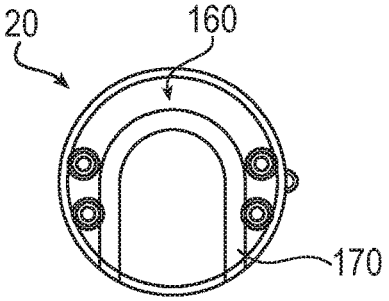
FIG. 6 is a lateral cross-section view of a dispensing unit, from a first longitudinal end of a barrel, at 6-6 of FIG. 2, in accordance with an embodiment of the invention.

FIG. 5 is a longitudinal cross-sectional view of a barrel 20. A first longitudinal end 130 is opposite a second longitudinal end 140. A lip 150 is formed on the second longitudinal end 140. Attached to the first longitudinal end 130 is an attachment system 160 for removeably attaching a barrel 20 to a handle. An end view of a barrel 20 form the second longitudinal end is provided in FIG. 6 to further illustrate the attachment system 160. In this particular embodiment, the attachment system 160 includes a semi-circular hooking mechanism 170 for slidably engaging a plate and/or fasteners on a handle. Other examples of an attachment mechanism include any mechanical fastener which may rigidly, pivotally and/or rotatably secure a barrel to a handle.

Figure 7:
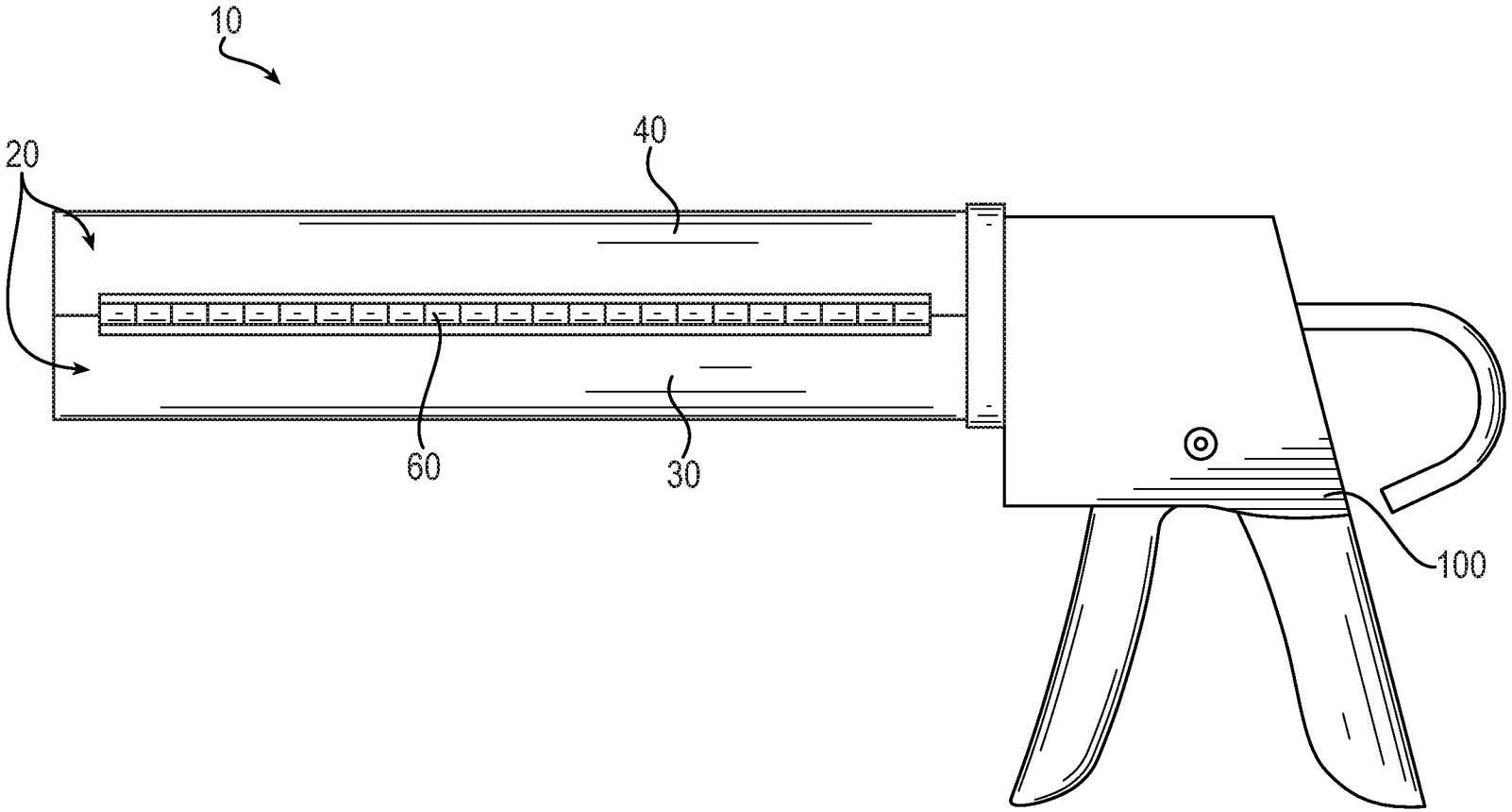
FIG. 7 is a side view of a dispensing unit in a closed position, in accordance with an embodiment of the invention.
Figure 8:
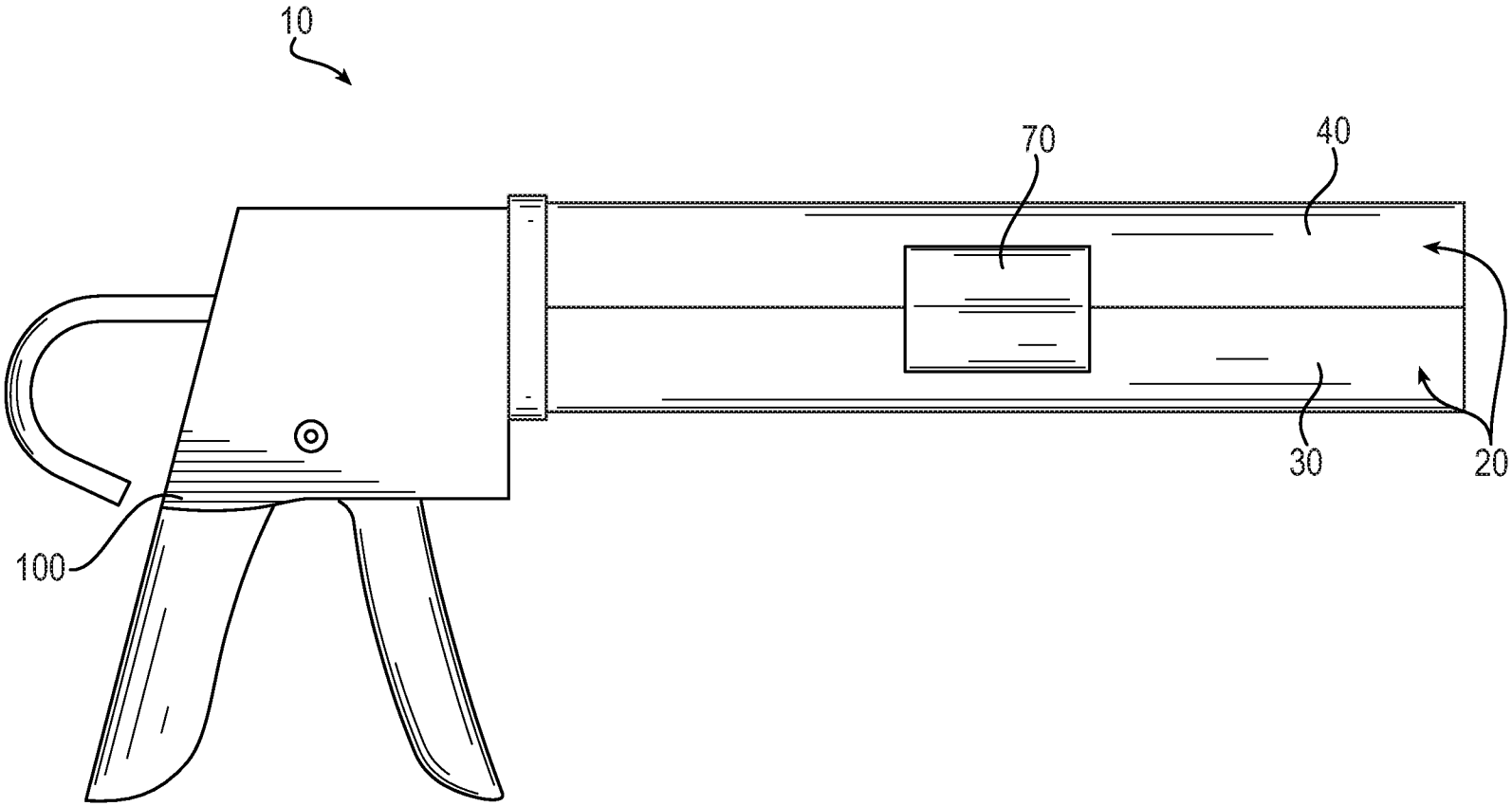
FIG. 8 is a side view of a dispensing unit in a closed position, in accordance with an embodiment of the invention.

FIG. 7 is a side view of a dispensing unit 10 having a handle 100 and a barrel 20. The barrel 20 is in a closed position. A pivot mechanism 60 for moveably connecting the first barrel portion 30 to the second barrel portion 40 is illustrated. FIG. 8 is also a side view of a dispensing unit 10 having a handle 100 and a barrel 20. Again, the barrel 20 is in a closed position. A clamp mechanism 70 for engaging and securing the second barrel portion 40 to the first barrel portion 30 is illustrated.

Figure 10:
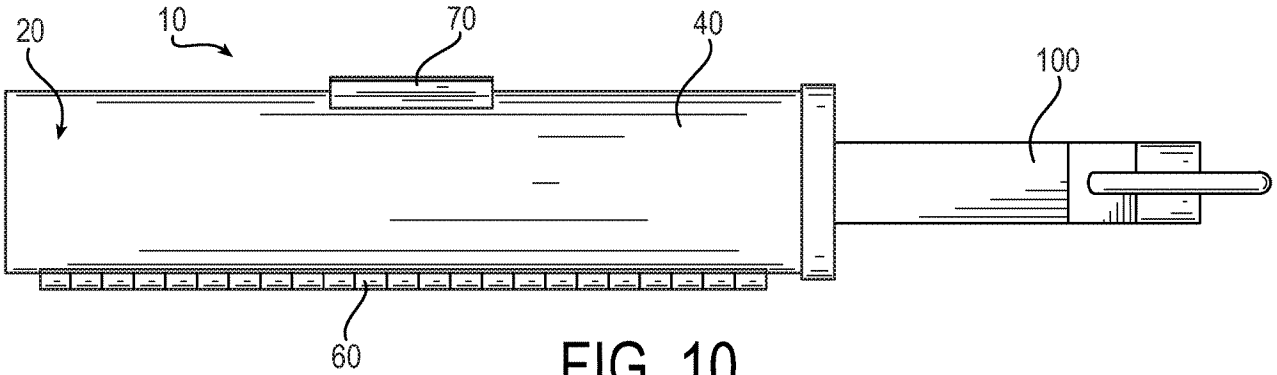
FIG. 10 is a top view of a dispensing unit in a closed position, in accordance with an embodiment of the invention.
Figure 11:
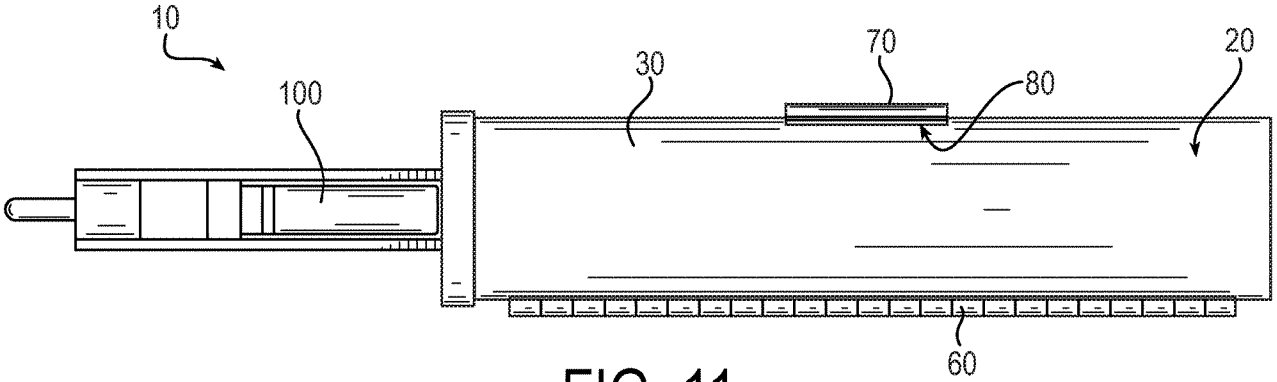
FIG. 11 is a bottom view a dispensing unit in a closed position, in accordance with an embodiment of the invention.

FIGS. 10-11 illustrate a top view and a bottom view of a dispensing unit 10 in a closed position, respectively. In FIG. 10 the second barrel portion 40 of the barrel 20 is illustrated with a clamp mechanism 70 and a pivot mechanism 60. The barrel 20 is attached to a handle 100. In FIG. 11 the first barrel portion 30 of the barrel 20 is illustrated with sawtooths 80 engaging the clamp mechanism 70. Also illustrated in FIG. 11 is the pivot mechanism 60.

Figure 13:
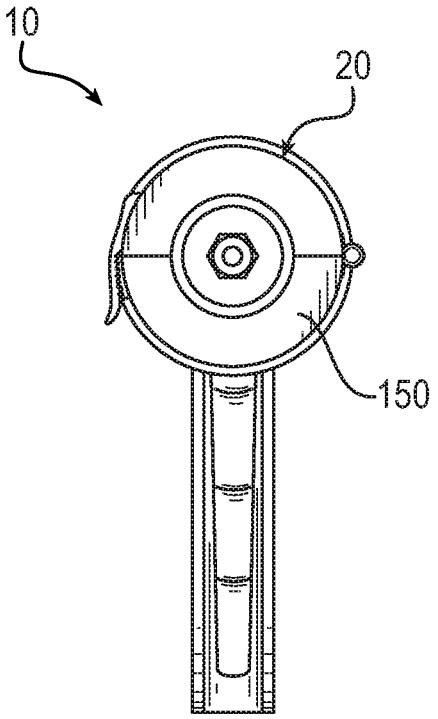
FIG. 13 is an end view, from a second longitudinal end, of a dispensing unit in a closed position, in accordance with an embodiment of the invention.
Figure 15:
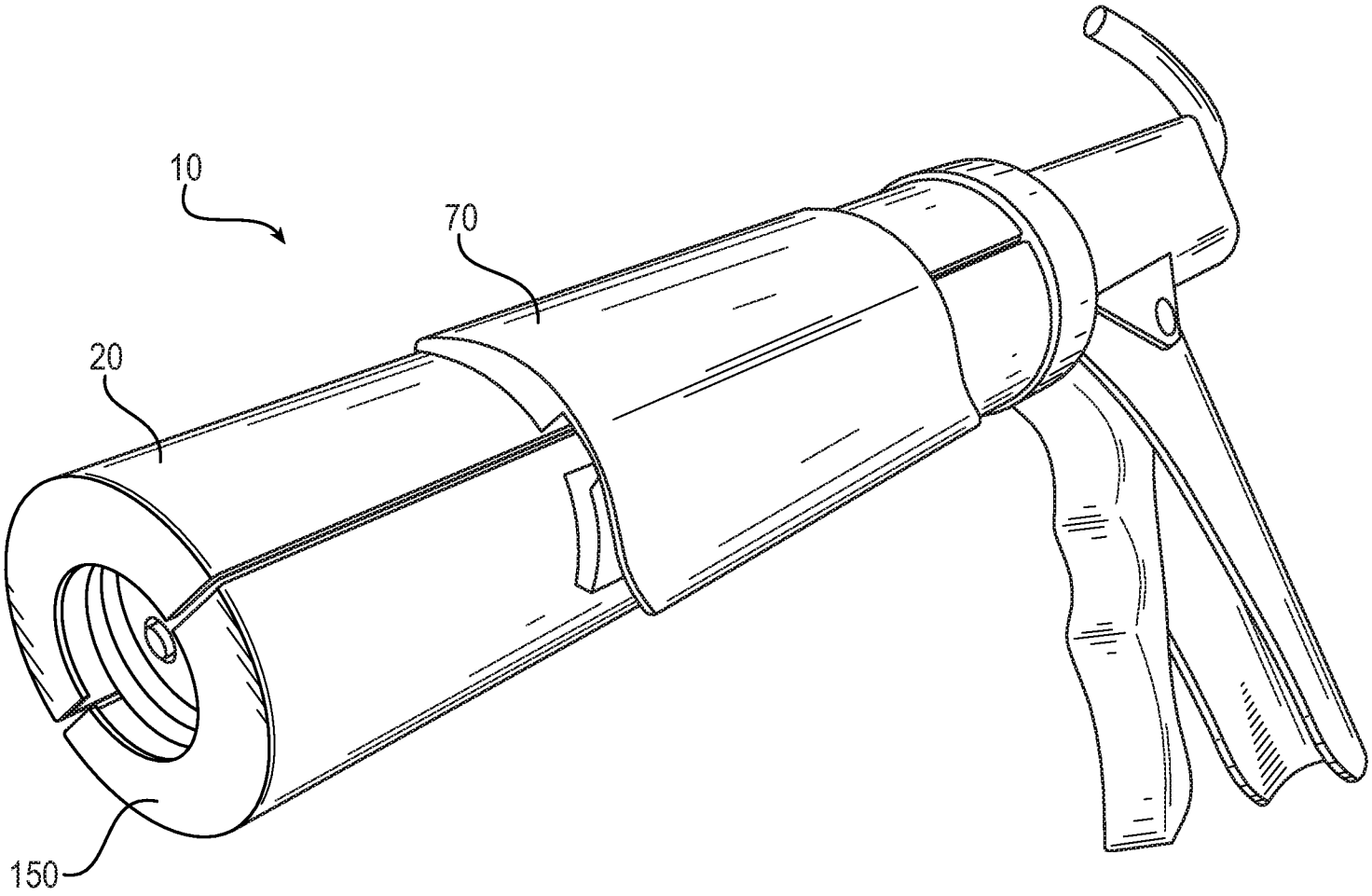
FIG. 15 is a side view of a dispensing unit in a closed position, in accordance with an embodiment of the invention.

FIGS. 12-15 illustrate additional embodiments of a dispensing unit 10. FIG. 12 illustrates a dispensing unit 10 having a larger clamp mechanism 70. FIG. 13 illustrates a dispensing unit 10 having a barrel 20 with a larger lip 150. FIG. 14 illustrates a dispensing unit 10 with a barrel 20 in an open position comprising a larger clamp mechanism 70 and a barrel 20 with a larger lip 150. FIG. 15 is a perspective view of the same but in a closed position.

The terms "comprising," "including," and "having," as used in the claims and specification herein, shall be considered as indicating an open group that may include other elements not specified. The terms "a," "an," and the singular form of words shall be taken to include the plural form of the same words, such that the terms mean that one or more of something is provided. The terms "at least one" and "one or more" are used interchangeably. The term "single" shall be used to indicate that one and only one of something is intended. Similarly, other specific integer values, such as "two," are used when a specific number of things are intended. The terms "preferably," "preferred," "prefer," "optionally," "may," and similar terms are used to indicate that an item, condition or step being referred to is an optional (i.e., not required) feature of the invention.

While this invention has been described with reference to particular embodiments thereof, it shall be understood that such description is by way of illustration only and should not be construed as limiting the scope of the claimed invention. Accordingly, the scope and content of the invention are to be defined only by the terms of the following claims. Furthermore, it is understood that the features of any specific embodiment discussed herein may be combined with one or more features of any one or more embodiments otherwise discussed or contemplated herein unless otherwise stated.

What is claimed is:

1. A dispensing unit comprising:

a dispensing mechanism;

a barrel extending from the dispensing mechanism and having a cavity defined therein, wherein the cavity extends longitudinally within the barrel and the barrel includes a first barrel portion and a second barrel portion encasing at least a portion of the cavity when in a closed position and an adjustment mechanism within the cavity wherein the adjustment mechanism is formed to be in communication with 80% or more of a material container positioned within the cavity and configured to prevent movement, including expansion, of the material container;

the first barrel portion attached to the dispensing mechanism and forming a seating surface for a material container;

the second barrel portion moveably attached to the first barrel portion by a pivot mechanism such that the second barrel portion is positioned opposite the first barrel portion in an inverted relationship, substantially encasing the cavity, when in the closed position and pivots to at least one side of the first barrel portion, exposing the cavity, when in an opened position; and a clasp mechanism for securing the second barrel portion to the first barrel portion in the closed position.

2. The dispensing unit of claim 1 wherein the adjustment mechanism is formed to be in communication with an entire perimeter of a material container positioned within the cavity and configured to prevent movement, including expansion, of the material container.

3. The dispensing unit of claim 1 where the adjustment mechanism is formed to be in communication with 80% or more of a cylindrical perimeter of a cylindrical material container positioned within the cavity and configured to prevent movement, including expansion, of the material container.

4. The dispensing unit of claim 1 where the adjustment mechanism is formed to be in communication with an entire cylindrical perimeter of a cylindrical material container positioned within the cavity and configured to prevent movement, including expansion, of the material container.

5. The dispensing unit of claim 1 wherein an inside surface of the barrel is adjustable by the adjustment mechanism and the first barrel portion and the second barrel portion, together and including the adjustment mechanism, are formed to be in substantial communication with a material container positioned within the cavity and configured to prevent expansion of the material container.

6. The dispensing unit of claim 1 wherein the pivot mechanism is a hinge.

7. The dispensing unit of claim 1 wherein the clasp mechanism is affixed to the second barrel portion and removably fastened to the first barrel portion.

8. The dispensing unit of claim 7 wherein the second barrel portion is removably fastened by a rapid mechanism.

9. The dispensing unit of claim 1 wherein the clasp mechanism includes one or more sawtooth(s) which removably engage the first barrel portion.

10. The dispensing unit of claim 9 wherein the first barrel portion includes one or more raised edges which the one or more sawtooth(s) removably engage.

11. A detachable barrel for attachment to a dispensing unit, the barrel comprising:

a barrel having a cavity defined therein, wherein the cavity extends longitudinally within the barrel and the barrel includes a first barrel portion and a second barrel portion substantially encasing the cavity when in a closed position;

the first barrel portion is removably attachable to the handle and forms a seating surface for a material container;

the second barrel portion moveably attached to the first barrel portion by a pivot mechanism such that the second barrel portion is positioned opposite the first barrel portion in an inverted relationship, substantially encasing the cavity, when in the closed position and pivots to at least one side of the first barrel portion, exposing the cavity, when in an opened position;

an adjustment mechanism within the cavity wherein the adjustment mechanism is formed to be in communication with 80% or more of a material container positioned within the cavity and configured to prevent movement, including expansion, of the material container; and a clasp mechanism for securing the second barrel portion to the first barrel portion in the closed position.

12. A method for dispensing, the method comprising:

inserting a material container within a barrel of a dispenser in an open position, the barrel comprising a cavity wherein the cavity extends longitudinally within the barrel and the barrel includes a first barrel portion and a second barrel portion substantially encasing the cavity when in a closed position, the first barrel portion attached to a dispensing mechanism and forming a seating surface for a material container;

the second barrel portion moveably attached to the first barrel portion by a pivot mechanism such that the second barrel portion is positioned opposite the first barrel portion in an inverted relationship, substantially encasing the cavity, when in the closed position and pivots to at least one side of the first barrel portion, exposing the cavity, when in an opened position;

an adjustment mechanism within the cavity wherein the adjustment mechanism is formed to be in communication with 80% or more of a material container positioned within the cavity and configured to prevent movement, including expansion, of the material container; and a clasp mechanism for securing the second barrel portion to the first barrel portion in the closed position;

closing the barrel into a closed position wherein the material container is substantially encased within the cavity of the barrel;

securing the first barrel portion to the second barrel portion with the clasp mechanism;

engaging the perimeter of the material container in substantial communication with an interior surface of the barrel to reduce expansion;

initiating the dispensing mechanism and applying pressure to the contents of the material container from a first longitudinal end of the barrel; and dispensing sealant from a nozzle of the material container extending from a second longitudinal end of the barrel.

13. The dispensing unit of claim 1 wherein the adjustment mechanism is a bladder.

14. The dispensing unit of claim 1 wherein the adjustment mechanism is a mechanical structure.

15. The dispensing unit of claim 1 wherein an inside surface of the barrel is in substantial communication with the adjustment mechanism positioned within the cavity.

* * * * *